US005922498A

United States Patent [19]

Yuh et al.

[11] Patent Number: 5,922,498

[45] Date of Patent: Jul. 13, 1999

[54] CHARGE GENERATING LAYER CONTAINING ACCEPTOR MOLECULE

[75] Inventors: Huoy-Jen Yuh, Pittsford; John S. Chambers, Rochester; Damodar M. Pai, Fairport, all of N.Y.

[73] Assignee: Xerox Corporation, Stamford, Conn.

[21] Appl. No.: 09/234,256

[22] Filed: Jan. 20, 1999

[51] Int. Cl.[6] ..... G03G 5/047; G03G 5/14

[52] U.S. Cl. ..... 430/58; 430/60; 430/131; 430/134

[58] Field of Search ..... 430/58, 59, 60, 430/131, 134

[56] References Cited

U.S. PATENT DOCUMENTS

| | | | |
|---|---|---|---|
| 3,947,410 | 3/1976 | Meyer et al. | 548/143 |
| 4,161,404 | 7/1979 | Enomoto et al. | 430/64 |
| 4,725,518 | 2/1988 | Carmichael et al. | 430/58 |
| 4,874,682 | 10/1989 | Scott et al. | 430/59 |
| 5,190,839 | 3/1993 | Fujimaki et al. | 430/78 |
| 5,308,726 | 5/1994 | Hirano et al. | 430/56 |
| 5,356,741 | 10/1994 | Carmichael et al. | 430/56 |
| 5,418,107 | 5/1995 | Nealey et al. | 430/132 |
| 5,437,950 | 8/1995 | Yu et al. | 430/58 |
| 5,443,934 | 8/1995 | Suzuki et al. | 430/64 |
| 5,681,664 | 10/1997 | Tamano et al. | 428/690 |
| 5,698,355 | 12/1997 | Imai et al. | 430/60 |
| 5,698,740 | 12/1997 | Enokida et al. | 564/308 |
| 5,759,726 | 6/1998 | Tambo et al. | 430/58 |
| 5,863,686 | 1/1999 | Yuh et al. | 430/134 |

FOREIGN PATENT DOCUMENTS

| | | |
|---|---|---|
| 53-048532 | 5/1978 | Japan . |
| 02146555 A2 | 6/1990 | Japan . |

OTHER PUBLICATIONS

"Organic Photoreceptors For Imaging Systems", Paul M. Borsenberger and David S. Weiss, New York: Marcel–Decker, Inc., pp. 101–105, 190, 191, 289–293, 330–339, (1993).

*Primary Examiner*—Roland Martin

[57] ABSTRACT

An electrophotographic imaging member including a supporting substrate, an undercoat layer doped with an acceptor molecule a charge generating layer comprising photoconductive pigment particles, film forming binder and an acceptor molecule dissolved in the film forming binder, the acceptor molecule represented by the formula

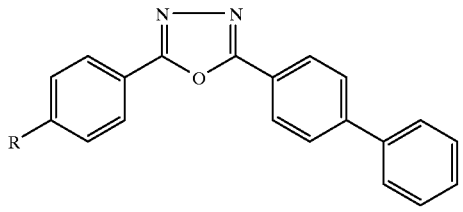

wherein R is an alkyl group containing 1 to 20 carbon atoms, and a charge transport layer, the charge generating layer being located between the substrate and the charge transport layer. A process for fabricating this imaging member is also disclosed.

13 Claims, No Drawings

CHARGE GENERATING LAYER CONTAINING ACCEPTOR MOLECULE

BACKGROUND OF THE INVENTION

This invention relates in general to electrophotography and more specifically, to an improved electrophotography imaging member having an a more sensitive charge generating layer.

In the art of electrophotography, an electrophotography plate comprising a photoconductive insulating layer on a conductive layer is imaged by first uniformly electrostatically charging surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers.

Electrophotographic imaging members are usually multilayered photoreceptors that comprise a substrate support, an electrically conductive layer, an optional hole blocking layer, an adhesive layer, a charge generating layer, and a charge transport layer in either a flexible belt form or a rigid drum configuration. For most multilayered flexible photoreceptor belts, an anti-curl layer is usually employed on the back side of the substrate support, opposite to the side of the electrically active layers, to render the desired photoreceptor flatness. One type of multilayered photoreceptor comprises a layer of finely divided particles of a photoconductive inorganic compound dispersed in an electrically insulating organic resin binder. In U.S. Pat. No. 4,265,990 a layered photoreceptor is disclosed having separate charge generating (photogenerating) and charge transport layers. The charge generating layer is capable of photogenerating holes and injecting the photogenerated holes into the charge transport layer. The photogenerating layer utilized in multilayered photoreceptors include, for example, inorganic photoconductive particles or organic photoconductive particles dispersed in a film forming polymeric binder. Inorganic or organic photoconductive material may be formed as a continuous, homogeneous photogenerating layer. Many suitable photogenerating materials known in the art can be utilized, if desired.

As more advanced, higher speed electrophotographic copiers, duplicators and printers were developed, degradation of image quality was encountered during extended cycling. Moreover, complex, highly sophisticated, duplicating and printing systems employed flexible photoreceptor belts, operating at very high speeds, have also placed stringent mechanical requirements and narrow operating limits as well on photoreceptors. Advanced photoreceptors have excellent electrical and mechanical properties. Some have very stable electrical performance over long life, for example, up to at least 200K cycles. However, many photoreceptors exhibit fluctuations in photosensitivity from batch to batch even where every effort is made to ensure identical processing conditions such as the milling of charge generation layer pigment dispersion under the same conditions. For example, when extrinsic photosensitive pigments are employed, the photogenerated carriers must be brought out of the surface of pigment particles before the carriers recombine and move into the charge transport layer under the applied electric field. This process slows down considerably in binders containing dispersed extrinsic photosensitive pigment particles such as benzimidazole perylene particles, especially at low applied electric fields. Under these conditions, the photoinduced discharged curve (PIDC) becomes softer at low field. Such a soft PIDC curve requires more powerful, bulky and expensive laser light sources for imaging in an electrophotographic printer or duplicator. The expression photoinduced discharged curve (PIDC) as employed herein is defined as a relationship between the potential as a function of exposure and is a measure of the sensitivity of the device. It generally represents the supply efficiency (number carriers injected from the generator layer into the transport layer per incident photon) as a function of the field across the device.

INFORMATION DISCLOSURE STATEMENT

U.S. Pat. No. 5,437,950 issued to Yu et al. on Aug. 1, 1995—An electrophotographic imaging member is disclosed including a substrate, an optional blocking layer, an optional thermoplastic adhesive interface layer, a thin charge generation layer comprising pigment particles dispersed in a film forming polymer binder having dissolved or molecularly dispersed therein an electron accepting/transporting compound, and a charge transport layer.

U.S. Pat. No. 4,161,404 issued to Enomoto et al. on Jul. 17, 1997—A photosensitive material is described for use in electrophotography which is prepared by forming a barrier layer containing a peptide polymer between a photosensitive material impedes unnecessary charge infiltration through the conductive support, maintains an appropriate charge acceptability, imparts an adhesive property of the photosensitive layer in relation to the support or flexibility of the photosensitive material, and prevents deterioration of such characteristics as photosensitivity, residual potential, etc. When some acceptor or donor is additionally mixed in said barrier layer, the electrification property thereof is improved. Enomoto et al. appears to be the U.S. equivalent of JP-B 61-03551 referred to in U.S. Pat. No. 5,759,726 to Tambo et al. below.

U.S. Pat. No. 5,759,726 issued to Tambo et al. on Jun. 2, 1998—An excellent electrographic photosensitive member is disclosed having a high sensitivity, a high chargeability and a low residual potential. The electrographic photosensitive member comprises a photosensitive layer, or a photosensitive layer and an underlayer superimposed over an electroconductive support, wherein the photosensitive layer and/or the underlayer contain a chlorogallium phthalocyanine which is substituted with an electron-withdrawing group and has a specified formula.

U.S. Pat. No. 5,308,726 issued to Hirano et al. on May 3, 1994—An electrophotographic photosensitive element is disclosed which comprises a conductive substrate and at least a photosensitive layer formed on the conductive substrate, the electrophotographic photosensitive element being characterized in that the photosensitive layer contains, as a charge transport material, a compound represented by specific formulae (1), (2) or (3).

U.S. Pat. No. 5,698,355 issued to Imai et al. on Dec. 16, 1997—A photosensitive body for electrophotography is disclosed having improved properties in the charging characteristics, photosensitivity, and stability in repeated use. The photosensitive body for electrophotography comprises a photoconductive layer formed on a conductive support through an undercoat layer, the undercoat layer containing at least one polyester compound having repeated units represented by a specified general formula (I).

U.S. Pat. No. 5,443,934 issued to Suzuki et al. on Aug. 22, 1995—An electrophotographic photoreceptor is disclosed comprising an electrically conductive substrate having thereon a subbing layer and a photosensitive layer in sequence, wherein the subbing layer is a layer formed by using a hydrolyzable compound, the layer having a residual organic group content of at least 25 mol % based on the total organic group content of the hydrolyzable compound used, or (ii) by coating a solution of the hydrolyzable compound in an organic solvent in which the hydrolyzable compound has been hydrolyzed to a degree of at least 50%. The coating composition exhibits satisfactory film-forming properties to form a subbing layer without causing cracks which thereby provides an electrophotographic photoreceptor with excellent stability on repeated use.

U.S. Pat. No. 5,356,741 issued to Carmichael et al. in Oct. 10, 1994—An electrophotographic imaging device comprising a charge generating layer and charge transport layer is disclosed involving the incorporation of at least weak acid or a weak base and the conjugated salt of the weak acid or weak base to reduce variations in the dark development potential an the background potential of the imaging device.

U.S. Pat. No. 4,725,518 issued to Carmichael et al. on Feb. 16, 1988—An electrophotographic imaging device comprising a charge generating layer and charge transport layer is disclosed in which an aromatic amine compound and a protonic acid or Lewis acid is added to the charge transport layer to control the dark development and background potentials of the imaging device.

U.S. Pat. No. 4,874,682 issued to Scott et al. on Oct. 1989—An electrophotographic imaging device comprising a charge generating layer and charge transport layer is disclosed in which a monomeric or polymeric non-volatile basic amine is incorporated in the charge transport layer to eliminate the fatigue effects of acids.

U.S. Pat. No. 5,190,839 issued to Fujimaki et al. on Mar. 2, 1993—An electrophotographic photoreceptor is disclosed. The photoreceptor contains in a light sensitive layer thereof a titanyl phthalocyanine having specific crystalline characteristics as defined in the specification and a polycyclic quinone pigment or a bisazo pigment as defined in the specification.

U.S. Pat. No. 5,418,107. to Richard Nealey et al., issued May 23, 1995—A process is disclosed for fabricating an electrophotographic imaging member including providing a substrate to be coated, forming a coating comprising photoconductive pigment particles having an average particle size of less than about 0.6 micrometer dispersed in a solution of a solvent comprising n-alkyl acetate having from 3 to 5 carbon atoms in the alkyl group and a film forming polymer consisting essentially of a film forming polymer having a polyvinyl butyral content between about 50 and about 75 mol percent, a polyvinyl alcohol content between about 12 and about 50 mol percent, and a polyvinyl acetate content is between about 0 to 15 mol percent, the photoconductive pigment particles including a mixture of at least two different phthalocyanine pigment particles free of vanadyl phthalocyanine pigment particles, drying the coating to remove substantially all of the alkyl acetate solvent to form a dried charge generation layer comprising between about 50 percent and about 90 percent by weight of the pigment particles based on the total weight of the dried charge generation layer, and forming a charge transport layer.

Japanese Patent Publication No. JP 02146555 A2, published Jun. 5, 1990—PURPOSE: To obtain the separate function type electrophotographic sensitive body having high sensitivity and excellent potential stability at the time of repetitive use by providing an undercoating layer containing an acid on a conductive base. CONSTITUTION: The under coating layer 2 is provided on the conductive base and a charge generating layer 3 and a charge transfer layer 4 are successively provided thereon. The under coating layer 2 is formed by application of a coating liquid which contains 0.0001 to 0.5 parts acid per 1 part weight binder resin of the under coating layer 2 and is prepared by incorporating the acid into a binder resin solution. Inorganic acids, such as hydrochloric acid, sulfuric acid, hydrobromic acid, phosphoric acid, and hydrofluoric acid, and organic acids, such as formic acid, acetic acid, propionic acid, butyric acid, lactic acid, benzoic acid, and benzensulfonic acid, are used as the acid to be incorporated into the coating liquid. The sensitivity is improved in this way and the potential stability at the time of repetitive use is improved. The residual potential is lowered and the deterioration in image quality is prevented.

Japanese Patent Publication No. JP 353048532A, published May 2, 1978—PURPOSE: The functions intrinsic to a barrier layer are performed without impairing characteristics such as photosensitivity, residual potential, etc., by providing the barrier layer containing peptide polymer between a conductive base and a photosensitive layer.

"Organic Photoreceptors For Imaging Systems", Paul M. Borsenberger and David S. Weiss, New York: Marcel-Decker, Inc. pp. 101–105, 190, 191, 289–293, 330–339, (1993). A photoreceptor having a charge transport layer on a charge generator layer is shown in FIG. 1. Charge transport layer materials combinations such as arylamines doping a polycarbonate binder are also described (pp. 190–191). Benzimidazole perylenes are disclosed as known charge generation materials for response at specific wavelengths (pp. 330–338).

Thus, there is a continuing need for photoreceptors having improved sensitivity, and for tools or controls to adjust the sensitivity of the photoreceptor to meet consistently meet exacting specifications in spite of batch to batch variations in the quality of the various component materials, especially the photoconductive pigment.

CROSS REFERENCE TO COPENDING APPLICATIONS

Application Serial No. 09/004,269 filed in the names of Huoy-Jen Yuh et al., entitled PHOTORECEPTOR WITH IMPROVED CHARGE GENERATING LAYER, filed on Jan. 8, 1998—An electrophotographic imaging member comprising

- a supporting substrate,
- an undercoat layer doped with an acceptor molecule
- a charge generating layer comprising
  - photoconductive pigment particles,
  - film forming binder and
  - an acceptor molecule dissolved in the film forming binder, and
- a charge transport layer,
  - the charge generating layer being located between the substrate and the charge transport layer.

A process for fabricating this imaging member is also disclosed. Specifically disclosed acceptor molecules include (4-n-butoxycarbonyl-9-fluorenylidene)malononitrile, terbutylphenol-oxadiazole and trifluoroacetic acid.

Application Serial No. 09/004,268 filed in the names of Huoy-Jen Yuh et al., entitled PHOTORECEPTOR WITH DONOR MOLECULE IN CHARGE GENERATING LAYER, filed Jan. 8, 1998 now U.S. Pat. No. 5,863,686.—An electrophotographic imaging member is disclosed comprising a supporting substrate, a charge generating layer comprising photoconductive pigment particles benzamidazole perylene or dibromoanthanthrone, a film forming binder of polyvinyl butyral and a donor charge transporting molecule dissolved in the binder, the donor charge transport molecule selected from the group consisting of N,N'-diphenyl-N,N'-bis(3-hydroxyphenyl)-[1,1'-biphenyl]-4,4'-diamine, N,N'-di(3-methoxyphenyl)-N,N'-diphenyl-[1,1-biphenyl]-4,4'-diamine and mixtures thereof and a charge transport layer, the charge generating layer being located between the substrate and the charge transport layer.

BRIEF SUMMARY OF THE INVENTION

It is, therefore, an object of the present invention to provide an improved electrophotographic imaging member and process for fabricating the imaging member.

It is another object of the present invention to provide an improved electrophotographic imaging member having greater sensitivity.

It is yet another object of the present invention to provide a quality control tool or solution to bring the sensitivity of an electrophotographic imaging member within narrow specifications in spite of quality variations between component materials from batch to batch, especially photoconductive pigments.

It is still another object of the present invention to provide a quality control tool or knob to bring the sensitivity of an electrophotographic imaging member within narrow specifications without major changes in the dispersion quality of charge generator layer dispersion or without any major changes to the fabrication process of the device.

The foregoing objects and others are accomplished in accordance with this invention by providing an electrophotographic imaging member comprising a supporting substrate, an undercoat layer doped with an acceptor molecule a charge generating layer comprising
photoconductive pigment particles,
film forming binder and
an acceptor molecule dissolved in the film forming binder, the acceptor molecule represented by the formula

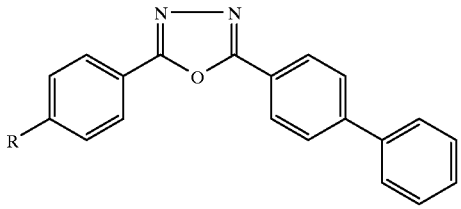

wherein R is an alkyl group containing 1 to 20 carbon atoms, and a charge transport layer, the charge generating layer being located between the substrate and the charge transport layer.

This imaging member may be fabricated by forming an undercoat layer from a coating solution, forming a charge generating layer from a coating dispersion comprising
photoconductive pigment particles dispersed in
a solution of a film forming binder dissolved in a solvent for the binder, forming a charge transport layer from a coating solution comprising
a charge transport molecule,
a film forming binder, and
solvent for the binder, and drying the coating to form a charge transport layer overlying the charge generating layer, wherein the undercoat layer coating solution, the charge generating layer dispersion, or both the undercoat layer coating solution and the charge generating layer dispersion comprise an acceptor molecule represented by the formula

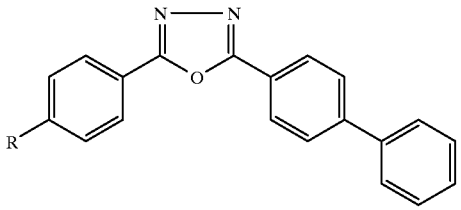

wherein R is an alkyl group containing 1 to 20 carbon atoms.

Generally, electrophotographic imaging members comprise a supporting substrate, having an electrically conductive surface or coated with an electrically conductive layer, an optional charge blocking layer, an undercoat layer, a charge generating layer, a charge transport layer and an optional overcoating layer.

The substrate may be opaque or substantially transparent and may comprise numerous suitable materials having the required mechanical properties. Accordingly, this substrate may comprise a layer of an electrically non-conductive or conductive material such as an inorganic or an organic composition. The electrically conductive layer may comprise the entire supporting substrate or merely be present as a coating on an underlying rigid or flexible web member. Any suitable electrically conductive material may be utilized. Typical electrically conductive materials include, for example, aluminum, titanium, nickel, chromium, brass, gold, stainless steel, copper iodide, and the like. When the conductive layer is to be flexible, it may vary in thickness over substantially wide ranges depending on the desired use of the electrophotoconductive member. Accordingly, the conductive layer can generally range in thicknesses of from about 50 Angstrom units to about 150 micrometers. As electrically non-conducting materials there may be employed various thermoplastic and thermoset resins known for this purpose including polyesters, polycarbonates, polyamides, polyurethanes, and the like. The substrate may have any suitable shape such as, for example, a flexible web, rigid cylinder, sheet and the like.

The thickness of a flexible substrate support depends on numerous factors, including economical considerations, and thus this layer for a flexible belt may be of substantial thickness, for example, over 200 micrometers, or of minimum thickness less than 50 micrometers, provided there are no adverse affects on the final photoconductive device.

Any suitable hole blocking layer capable of forming an electronic barrier to holes between the adjacent photoconductive layer and the underlying conductive layer may be utilized. A hole blocking layer may comprise any suitable material. Typical hole blocking layers utilized for the negatively charged photoreceptors may include, for example, Luckamide, hydroxy alkyl methacrylates, nylons, gelatin, hydroxyl alkyl cellulose, organopolyphosphazines, organosilanes, organotitanates, organozirconates, silicon oxides, zirconium oxides, and the like. Preferably, the hole blocking layer comprises nitrogen containing siloxanes. Typical nitrogen containing siloxanes are prepared from coating solutions containing a hydrolyzed silane. Typical hydrolyzable silanes include 3-aminopropyl triethoxysilane, (N,N'-dimethyl 3-amino) propyl triethoxysilane, N,N-dimethylamino phenyl triethoxy silane, N-phenyl aminopropyl trimethoxy silane, trimethoxy silylpropyldiethylene triamine and mixtures thereof.

During hydrolysis of the amino silanes described above, the alkoxy groups are replaced with hydroxyl group. An especially preferred blocking layer comprises a reaction product between a hydrolyzed silane and the oxidized surface of an underlying conductive layer which inherently forms on the surface of conductive a metal layer when exposed to air after deposition. This combination reduces spots at time 0 and provides electrical stability at low RH. The imaging member is prepared by depositing on the conductive layer of a coating of an aqueous solution of the hydrolyzed silane at a pH between about 4 and about 10, drying the reaction product layer to form a siloxane film and applying electrically active layers, such as a photogenerator layer and a hole transport layer, to the siloxane film.

The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. This siloxane coating is described in U.S. Pat. No. 4,464,450, the disclosure of thereof being incorporated herein in its entirety. After drying, the siloxane reaction product film formed from the hydrolyzed silane contains larger molecules. The reaction product of the hydrolyzed silane may be linear, partially crosslinked, a dimer, a trimer, and the like.

A preferred charge blocking layer may be fabricated from a solution of zirconium butoxide and gamma-amino propyl tri-methoxy silane in a suitable solvent such as an isopropyl alcohol, butyl alcohol and water mixture. Generally, a preferred solution comprises between about 70 and about 90 by weight of zirconium butoxide and between about 30 and about 10 by weight of gamma-amino propyl tri-methoxy silane, based on the total weight of solids in the solution.

The blocking layer should be continuous and have a thickness of less than about 0.5 micrometer because greater thicknesses may lead to undesirably high residual voltage. A blocking layer of between about 0.005 micrometer and about 0.3 micrometer (50 Angstroms-3000 Angstroms) is preferred because charge neutralization after the exposure step is facilitated and optimum electrical performance is achieved. A thickness of between about 0.03 micrometer and about 0.06 micrometer is preferred for metal oxide is layers for optimum electrical characteristics.

Any suitable undercoat layer may be applied to the charge blocking layer. Undercoat layer materials are well known in the art. Typical undercoat layer materials include, for example, polyesters, MOR-ESTER 49,000 (available from Morton International Inc.), Vitel PE-100, Vitel PE-200, Vitel PE-200D, and Vitel PE-222 (all Vitels available from Goodyear Tire and Rubber Co.), polyarylates (Ardel, available from AMOCO Production Products), polysulfone (available from AMOCO Production Products), polyurethanes, and the like. The MOR-ESTER 49000 polyester resin is a linear saturated copolyester reaction product of ethylene glycol with terephthalic acid, isophthalic acid, adipic acid and azelaic acid. Other polyester resins which are chemically similar to the 49000 polyester resin and which are also suitable for a photoreceptor undercoat layer coating include Vitel PE-100 and Vitel PE-200, both of which are available from Goodyear Tire & Rubber Co. An especially preferred undercoat layer material is a polyamide such as Luckamide 5003 from Dai Nippon Ink, Nylon 8 with methylmethoxy pendant groups, CM 4000 and CM 8000 from Toray Industries Ltd and other N-methoxymethylated polyamides, such as those prepared according to the method described in Sorenson and Campbell "Preparative Methods of Polymer Chemistry" second edition, pg 76, John Wiley and Sons Inc., 1968 and the like and the mixtures thereof. These polyamides can be alcohol soluble, for example, with polar functional groups, such as methoxy, ethoxy and hydroxy groups, pendant from the polymer backbone. Any suitable alcohol solvent or solvent mixtures may be employed to form a coating solution. Typical solvents include methanol, ethanol, propanol and mixtures thereof. Water may optionally be added to the solvent mixture. Satisfactory results may be achieved with a dry undercoat layer thickness between about 0.05 micrometer and about 0.3 micrometer. Conventional techniques for applying an undercoat layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like. In some embodiments, the undercoat layer functions as a blocking layer and there is no need for a separate blocking layer beneath the undercoat layer.

Any suitable charge generating binder layer comprising photoconductive particles dispersed in a film forming binder may be utilized. Photoconductive particles for charge generating binder layer such vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially sensitive to white light.

Any suitable polymeric film forming binder material may be employed as the matrix in the charge generating (charge generation) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

Any suitable organic solvent may be utilized to dissolve the film forming binder. Typical solvents include n-butyl acetate, cyclohexanone, methyl ethyl ketone (MEK) and the like. The solvent n-butyl acetate is preferred because the dispersion quality of the coating mixture is superior. Coating dispersions for charge generating layer may be formed by any suitable technique using, for example, attritors, ball mills, Dynomills, paint shakers, homogenizers, microfluidizers, and the like. The charge generation layer containing photoconductive pigments and the resinous binder material generally has a thickness of between about 0.1 micrometer and about 5 micrometers, and preferably has a thickness of between about 0.3 micrometer and about 2 micrometers. The charge generation layer thickness is related to binder content. Higher is binder content compositions generally require thicker layers for photogeneration. Thicknesses outside these ranges can be selected providing the objectives of the present invention are achieved. Typical charge generating layer thicknesses have an optical density of between about 1.7 and about 2.1.

Any suitable and conventional technique may be utilized to mix and thereafter apply the charge generation layer coating mixture. Typical application techniques include slot coating, gravure coating, roll coating, spray coating, spring wound bar coating, dip coating, draw bar coating, reverse roll coating, and the like.

Any suitable drying technique may be utilized to solidify and dry the deposited coatings. Typical drying techniques include oven drying, forced air drying, infrared radiation drying, and the like.

The charge generation composition or pigment is present in the resinous binder composition in various amounts. Generally, however, from about 5 percent by volume to about 90 percent by volume of the charge generation pigment is dispersed in about 10 percent by volume to about 95 percent by volume of the resinous binder, and preferably from about 20 percent by volume to about 30 percent by volume of the charge generation pigment is dispersed in about 70 percent by volume to about 80 percent by volume of the resinous binder composition.

The charge generating layer of the photoreceptor of this invention preferably comprises a perylene pigment as a solution coated layer containing the pigment dispersed in a film forming resin binder. For photoreceptors utilizing a perylene charge generating layer, the perylene pigment is preferably benzimidazole perylene which is also referred to as bis(benzimidazole). This pigment exists in the cis and trans forms. The cis form is also called bis-benzimidazo(2,1-a-1',1'-b)anthra(2,1,9-def:6,5,10-d'e'f')disoquinoline-6,11-dione. The trans form is also called bisbenzimidazo(2,1-a1',1'-b)anthra(2,1,9-def:6,5,10-d'e'f')disoquinoline-10,21-dione. This pigment may be prepared by reacting perylene 3,4,9,10-tetracarboxylic acid dianhydride with 1,2-phenylene. Benzimidazole perylene compositions are well known and described for example, in U.S. Pat. No. 5,019,473 U.S. Pat. No. 4,587,189, the entire disclosures thereof being incorporated herein by reference. Benzimidazole perylene may be ground into fine particles having an average particle size of less than about 1 micrometer. Optimum results are achieved with a pigment particle size between about 0.2 micrometer and about 0.3 micrometer. Other suitable charge generation materials known in the art may also be utilized, if desired.

Although photoreceptor embodiments prepared with a charge generating layer comprising benzimidazole perylene dispersed in various types of resin binders give reasonably good results, the sensitivity of the photoreceptor is found to be dramatically improved, particularly, with the use of benzimidazole perylene dispersed in polyvinyl butyral in combination with the acceptor molecule dissolved in the polyvinyl butyral film forming binder.

Although the electrophotographic imaging member of this invention must contain an acceptor molecule represented by the formula

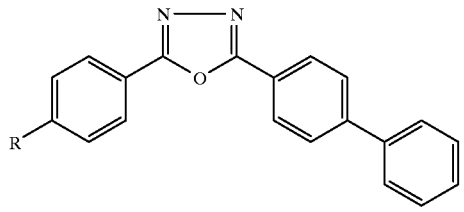

wherein R is an alkyl group containing 1 to 20 carbon atoms dissolved in the film forming binder of the charge generating layer after drying, the original source of this acceptor molecule during fabrication of the imaging member may be only the undercoat layer, only the charge generation layer, or both the undercoat layer and the charge generating layer. The expression acceptor molecule, as employed herein, is defined as a molecule having the above structural formulae that withdraws an electron from the photogenerating pigment. R may be any suitable alkyl group such as methyl, ethyl, propyl, isopropyl, butyl, isobutyl, tertiary butyl, pentyl, hexyl, and the like. A preferred acceptor molecule is represented by the formula

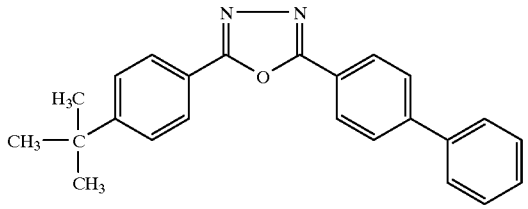

The concentration of the above acceptor molecule in the final dried generator layer is dependent on the specific acceptor molecule selected and can be as little as 0.001 to as high as 20 weight percent. based on the total weight of the generator layer. When the proportion of acceptor is less than about 0.001 percent by weight, based on the total weight of the charge generating layer, the imaging member shows no improvement in the sensitivity. When the proportion of acceptor is greater than about 20 percent by weight, based on the total weight of the charge generating layer, the imaging member cyclic instability and print quality degradation occurs. If desired, the acceptor may be added only to the undercoat layer coating composition during fabrication of the imaging member. Where the original source of the acceptor molecule during fabrication of the imaging member is only the undercoat layer, the concentration of the acceptor in the undercoat coating solution should be sufficient to supply migrated acceptor material to the charge generating layer which is deposited onto the undercoat layer. To ensure migration of the acceptor material from the undercoat layer to the charge generation layer, the specific acceptor added to the undercoat coating should be soluble in both the specific solvent and the specific film forming binder used for forming the charge generating layer. An acceptor is deemed soluble in the specific solvent and the specific film forming binder used in the charge generating layer when a clear, transparent solution is formed by the mixture of the three miscible components. The acceptor molecule should also be soluble in the solvent and film forming binder used for the undercoat layer in embodiments where the undercoat supplies the acceptor molecule to the charge generating layer. Also, if the undercoat does not supply acceptor molecule to the charge generating layer (i.e., the acceptor molecule is added only to the charge generating layer coating mixture), the acceptor molecule need not be soluble in the undercoat binder. In addition, the film forming binder used in the undercoat should be insoluble in the solvent used for the charge generating layer. Further, the film forming binder used in the undercoat layer should be immiscible in the film forming binder of the charge generating layer. Typical film forming binders include, for example, polyvinyl butyral (PVB), terpolymer of vinyl chloride vinyl acetate and acetic acid (VMCH), polyamide, and the like. In still another alternative embodiment, acceptor molecules originating from the undercoat layer supplement, through migration, acceptor molecule deliberately added to the charge generating coating mixture prior to formation of the charge generation layer. Regardless of which of the various embodiments described above are employed to fabricate the electrophotographic imaging member, satisfactory results can be achieved where the final dried charge generating layer contains between about 0.001 and about 20 percent by weight of acceptor molecule represented by the formulae above, the optimum range depending on the particular acceptor molecule selected, based on the total weight of the charge generating layer. The preferred amounts to be employed depends upon the specific acceptor molecule selected. By originally adding the acceptor molecule only to the charge generating layer coating composition, or only to the undercoat coating composition, rather than doping through addition to the transport layer undesirable contamination of the charge transport layer with the acceptor molecule is minimized or prevented. Optimum prevention of contamination is achieved when the only source of the acceptor molecule is the undercoat layer coating composition.

Any suitable charge transport layer may be utilized on the charge generator layer. The active charge transport layer may comprise any suitable transparent organic polymer of non-polymeric material capable of supporting the injection of photo-generated holes and electrons from the charge generating layer and allowing the transport of these holes or electrons through the organic layer to selectively discharge the surface charge. The charge transport layer in conjunction with the generation layer in the instant invention is a material which is an insulator to the extent that an electrostatic charge placed on the transport layer is not conducted in the absence of illumination Thus, the active charge transport layer is a substantially non-photoconductive material which supports the injection of photogenerated holes from the generation layer.

An especially preferred transport layer employed in one of the two electrically operative layers in the multilayer photoconductor of this invention comprises from about 25 to about 75 percent by weight of at least one charge transporting aromatic amine compound, and about 75 to about 25 percent by weight of a polymeric film forming resin in which the aromatic amine is soluble. A dried charge transport layer containing between about 40 percent and about 50 percent by weight of the small molecule charge transport molecule based on the total weight of the dried charge transport layer is preferred.

The charge transport layer forming mixture preferably comprises an aromatic amine compound. Typical aromatic amine compounds include triphenyl amines, bis and poly triarylamines, bis arylamine ethers, bis alkyl-arylamines and the like.

Examples of charge transporting aromatic amines for charge transport layers capable of supporting the injection of photogenerated holes of a charge generating layer and transporting the holes through the charge transport layer include, for example, triphenylmethane, bis(4-diethylamine-2-methylphenyl)phenylmethane; 4'-4"-bis(diethylamino)-2', 2"-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3"-methylphenyl)-(1,1'-biphenyl)-4,4'-diamine, and the like dispersed in an inactive resin binder.

Any suitable inactive resin binder soluble in methylene chloride or other suitable solvent may be employed in the process of this invention. Typical inactive resin binders soluble in methylene chloride include polycarbonate resin, polyester, polyarylate, polyacrylate, polyether, polysulfone, and the like. Molecular weights can vary, for example, from about 20,000 to about 1,500,000.

The preferred electrically inactive resin materials are polycarbonate resins have a molecular weight from about 20,000 to about 120,000, more preferably from about 50,000 to about 100,000. The materials most preferred as the electrically inactive resin material is poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 100,000, available as Makrolon from Farbenfabricken Bayer A. G., a polycarbonate resin having a molecular weight of from about 20,000 to about 50,000 available as Merlon from Mobay Chemical Company and poly(4,4'-diphenyl-1,1'-cyclohexane carbonate) with a molecular weight of from about 35,000 to about 40,000, available as PCZ 400 available from Mitsubishi Chemical Co. Excellent results are achieved when the charge transport layer comprises N,N'-diphenyl-N,N'-bis(3-methylphenyl)-[1,1'-biphenyl]-4,4'-diamine in poly(4,4'-diphenyl-1,1'-cyclohexane carbonate) binder.

Examples of photosensitive members having at least two electrically operative layers include the charge generator layer and diamine containing transport layer members disclosed in U.S. Pat. No. 4,265,990, U.S. Pat. No. 4,233,384, U.S. Pat. No. 4,306,008, U.S. Pat. No. 4,439,507. The disclosures of these patents are incorporated herein in their entirety.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like. Generally, the thickness of the transport layer is between about 5 micrometers to about 100 micrometers, but thicknesses outside this range can also be used. A dried thickness of between about 18 micrometers and about 35 micrometers is preferred with optimum results being achieved with a thickness between about 20 micrometers and about 29 micrometers. Preferably, the charge transport layer comprises an arylamine small molecule dissolved or molecularly dispersed in a polycarbonate.

Other layers such as conventional ground strips comprising, for example, conductive particles disposed in a film forming binder may be applied to one edge of the photoreceptor in contact with the conductive surface or layer, blocking layer, adhesive layer or charge generating layer.

Optionally, an overcoat layer may also be utilized to improve resistance to abrasion. In some cases a back coating may be applied to the side opposite the photoreceptor to provide flatness and/or abrasion resistance. These overcoating and backcoating layers may comprise organic polymers or inorganic polymers that are electrically insulating or slightly semi-conductive.

The improved electrophotographic imaging members of this invention exhibit greater sensitivity. Further, diffusion of dopant from the charge generating layer to the charge transport layer is reduced by initially forming an undercoat layer containing the dopant whereby diffusion of the dopant occurs after the charge generating layer is applied to the undercoat layer. By inhibiting migration of the dopant to the charge transport layer, oxidation of hole transport molecules in the charge transport layer is reduced. A high concentration of the acceptor molecule results in a charge transfer complex between the donor molecules in the transport molecule and the acceptor molecules of this invention. A charge transfer complex in the transport layer results in light absorption in the transport layer which is not a desirable outcome during imaging. By initially adding the acceptor molecule to either the undercoat layer coating solution or the generator layer coating dispersion or to both the undercoat layer coating solution and the generator layer dispersion, the sensitivity of the final photoreceptor can be precisely achieved and predictably controlled even when there is batch to batch component quality variations in the generator layer binder, generator layer pigments, or undercoat layer polymer.

PREFERRED EMBODIMENT OF THE INVENTION

The invention will now be described in detail with respect to the specific preferred embodiments thereof, it being understood that these examples are intended to be illustrative only and that the invention is not intended to be limited to the materials, conditions, process parameters and the like recited herein. All parts and percentages are by weight unless otherwise indicated.

Electrical Scanning Test

The electrical properties of photoconductive imaging samples prepared according to Examples I, II, and III, were evaluated with a xerographic testing scanner comprising a cylindrical photoreceptor drum having a diameter of 8.4 cm. When rotated, the drum produced a constant surface speed of 7.4 cm per second. A direct current pin corotron, exposure light, erase light, and three electrometer probes were mounted around the periphery of the photoreceptor samples. The sample charging time was 33 milliseconds. Both expose and erase lights were red LED bars with output wavelength at 660 nm. The output energy of the LED bar was controlled by varying the applied voltage to the LED bar. The relative locations of the probes and lights are indicated in the Table below:

TABLE

| Element | Angle (Degrees) |
|---|---|
| Charge | 0 |
| Probe 1 | 14 |
| Expose | 30 |
| Probe 2 | 90 |
| Erase | 225 |
| Probe 3 | 345 |

The test samples were first rested in the dark for at least 60 minutes to ensure achievement of equilibrium with the testing conditions at 35 percent relative humidity and 20° C. Each sample was then negatively charged in the dark to a development potential of about 700 volts. The charge acceptance of each sample and its residual potential after discharge by front erase exposure to 400 ergs/cm$^2$ were recorded. The test procedure was repeated to determine the photoinduced discharge characteristic (PIDC) of each sample by exposing the test samples to different light energies of up to 20 ergs/cm$^2$.

Comparative Example I

A charge blocking layer was fabricated from a 14.4 percent by weight solution of zirconium butoxide and gamma-amino propyl tri-methoxy silane in an isopropyl alcohol, butyl alcohol and water mixture. The isopropyl alcohol, butyl alcohol and water mixture proportions were 66, 33 and 1 percent by weight, respectively, based on the combined weight of the isopropyl alcohol, butyl alcohol and water. The zirconium butoxide and gamma-amino propyl tri-methoxy silane mixture percentages were 90 and 10 percent by weight, based on the combined weight of the zirconium butoxide and gamma-amino propyl tri-methoxy silane. The charge blocking layer was dip coated onto an aluminum drum substrate and dried at a temperature of 130° C. for 20 minutes. The dried zirconium film has a thickness of about 0.1 micrometer. A charge generation coating dispersion was prepared by dispersing 22 grams of benzimidazole perylene particles having an average particle size of about 0.4 micrometer into a solution of 10 grams polyvinyl butyral (B-79, available from Monsanto Chemical Co.) dissolved in 368 grams of n-butyl acetate solvent. This dispersion was milled in a Dynomill mill (KDL, available from Glen Mill) with zirconium balls having a diameter of 0.4 millimeter for 4 hours. The average particle size of the benzimidazole perylene pigments in the dispersion after the milling was about 0.1 micrometer. The drum with the charge blocking layer coating was dipped in the charge generation coating dispersion and withdrawn at a rate of 20 centimeters per minute. The resulting coated drum was air dried to form a 0.5 micrometer thick charge generating layer. A charge transport layer coating solution was prepared containing 40 grams of N,N'-diphenyl-N,N'-bis(3-methylphenyl)-[1,1'-biphenyl]-4,4'-diamine and 60 grams of poly(4,4'-diphenyl-1,1'-cyclohexane carbonate) (PCZ 400 available from Mitsubishi Chemical Co.) dissolved in a solvent mixture consisting of 80 grams of monochlorobenzene and 320 grams of tetrahydrofuran. The charge transport coating solution was applied onto the coated drum by dipping the drum into the charge transport coating solution and withdrawing at a rate of 150 centimeters per second. The coated drum was dried at 110° C. for 20 minutes to form a 20 micrometer thick charge transport layer. The resulting photoreceptor drum was electrically cycled in a scanner in a controlled atmosphere of 35 percent relative humidity and 20° C. The scanner is described above.

Comparative II

The process described in Example I was repeated except that the charge transport layer thickness was 25 micrometers. The resulting photoreceptor drum was electrically cycled in a scanner under the same conditions as described in Example I. The results are summarized in Table 1 below.

Example III

The process described in Example 11 was repeated except that the charge generation layer dispersion used for coating was different. The charge generation layer dispersion was prepared as described in the Example I, but was modified by the addition, after the milling, of 2.2 grams of an acceptor molecule represented by the formula

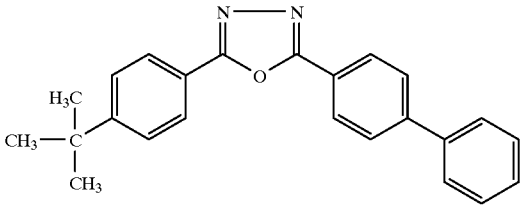

The resulting photoreceptor drum was electrically cycled in a scanner under the same conditions as described in Example I. The results are summarized in the table 1. The sensitivity was improved by lowering the surface voltage at the PIDC tail, evident as less exposure energy required for the photoreceptor to discharge to 100 v, as compared to the results from Comparative Example II. The results of the scanner test is shown in Table 1 below:

TABLE 1

| | Example I | Example II | Example III |
|---|---|---|---|
| $V_H$ | 693 | 687 | 690 |
| Dark decay (v) | 17 | 24 | 22 |
| X(100V) ergs/cm$^2$ | 10.4 | 8.4 | 7.9 |
| V(9 ergs/cm$^2$) | 118 | 76 | 60 |
| Vr (V) | 8 | 9 | 15 |

The symbols employed in the above table are defined as follows:
$V_{depletion}$ is the calculated voltage intercept on a QV charging curve.
Dark Decay is the voltage difference between the first and second probes.
$V_H$ is the voltage measured at the first probe.
V (9 ergs/cm$^2$) is the voltage measured at the first probe after the photoreceptor is exposed to light of intensity 9 ergs/cm$^2$.
$V_r$ is the voltage measured at the third probe.

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. An electrophotographic imaging member comprising a supporting substrate, an undercoat layer a charge generating layer comprising
photoconductive pigment particles,
film forming binder and
an acceptor molecule dissolved in the film forming binder, the acceptor molecule represented by the formula

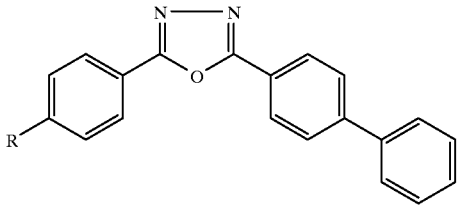

wherein R is an alkyl group containing 1 to 20 carbon atoms, and a charge transport layer, the charge generating layer being located between the substrate and the charge transport layer.

2. An electrophotographic imaging member according to claim 1 wherein the acceptor molecule is represented by the formula

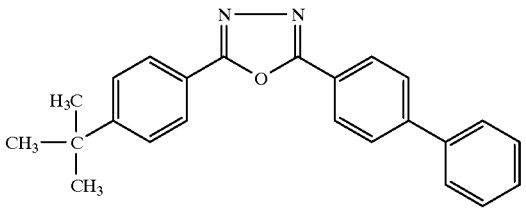

3. An electrophotographic imaging member according to claim 1 wherein the film forming binder is polyvinyl butyral.

4. An electrophotographic imaging member according to claim 1 wherein the charge generating layer comprises between about 2 and about 20 percent by weight of the acceptor molecule, based on the total weight of the charge generating layer.

5. An electrophotographic imaging member according to claim 1 wherein the undercoat layer comprises of zirconium butoxide and gamma-amino propyl tri-methoxy silane.

6. An electrophotographic imaging member according to claim 1 wherein the undercoat layer comprises polyamide.

7. An electrophotographic imaging member according to claim 5 wherein the undercoat layer comprises between about 2 and about 20 percent by weight of the acceptor molecule, based on the total weight of the undercoat layer.

8. An electrophotographic imaging member according to claim 1 wherein the charge transport layer comprises N,N'-diphenyl-N,N'-bis(3-methylphenyl)-[1,1'-biphenyl]-4,4'-diamine in a polycarbonate binder.

9. An electrophotographic imaging member according to claim 8 wherein the polycarbonate film forming binder comprises poly(4,4'-diphenyl-1,1'-cyclohexane carbonate).

10. An electrophotographic imaging member according to claim 1 wherein the photoconductive pigment particles comprise benzimidazole perylene pigment particles.

11. A processes for fabricating an electrophotographic imaging member comprising forming an undercoat layer from a coating solution, forming a charge generating layer from a coating dispersion comprising
photoconductive pigment particles dispersed in
a solution of a film forming binder dissolved in a solvent for the binder, forming a charge transport layer from a coating solution comprising
a charge transport molecule, a film forming binder, and solvent for the binder, and drying the coating to form a charge transport layer overlying the charge generating layer, wherein the undercoat layer coating solution, the charge generating layer dispersion, or both the undercoat layer coating solution and the charge generating layer dispersion comprise an acceptor molecule represented by the formula

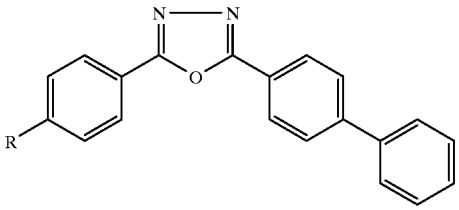

wherein R is an alkyl group containing 1 to 20 carbon atoms.

12. A process for fabricating an electrophotographic imaging member according to claim 11 wherein the charge generating layer comprises between about 0.001 percent and about 20 percent by weight of the acceptor molecule, based on the total weight of the charge generating layer after drying.

13. A process for fabricating an electrophotographic imaging member according to claim 11 wherein the acceptor molecule is represented by the formula

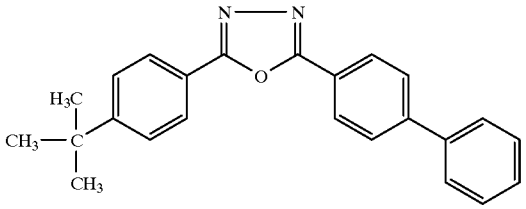

* * * * *